US007170020B2

(12) United States Patent
Kawata et al.

(10) Patent No.: US 7,170,020 B2
(45) Date of Patent: Jan. 30, 2007

(54) CIRCUIT BREAKER AND TERMINAL COVER

(75) Inventors: Hisao Kawata, Saitama (JP); Katsunori Kuboyama, Saitama (JP); Isamu Nagahiro, Saitama (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/107,893

(22) Filed: Apr. 18, 2005

(65) Prior Publication Data

US 2005/0280973 A1 Dec. 22, 2005

(30) Foreign Application Priority Data

May 19, 2004 (JP) ..... 2004-148751

(51) Int. Cl.
*H01H 13/04* (2006.01)
*H01H 19/04* (2006.01)

(52) U.S. Cl. ..... 200/333; 200/293

(58) Field of Classification Search ..... 200/333
See application file for complete search history.

(56) References Cited

U.S. PATENT DOCUMENTS 3,594,524 A * 7/1971 Heintz ..... 200/84 R
5,304,761 A * 4/1994 Rosen et al. ..... 218/157
6,144,001 A * 11/2000 Green et al. ..... 200/304
7,009,126 B2 * 3/2006 Etscheidt et al. ..... 200/293
2003/0075429 A1 4/2003 Whipple et al.

FOREIGN PATENT DOCUMENTS

| | | |
|---|---|---|
| EP | 1 296 340 A1 | 3/2003 |
| JP | H08-153438 | 6/1996 |
| JP | 2003-257299 | 9/2003 |

* cited by examiner

*Primary Examiner*—Elvin Enad
*Assistant Examiner*—Lheiren Mae A. Anglo
(74) *Attorney, Agent, or Firm*—Manabu Kanesaka

(57) ABSTRACT

A circuit breaker includes terminals with screws on a power supply side and a load side disposed at a front end section and a rear end section of a main body case containing a current interrupting unit and a switching mechanism. A terminal cover is detachably attached onto the main body case at a position corresponding to the terminals on at least one of the power supply side and the load side. A terminal cover attaching surface is formed on an upper surface on the power supply side and/or the load side of the main body case. The terminal cover is inserted while sliding on the attaching surface from a front end, so that the terminal cover is attached to the main body case with a snap-fit coupling unit at an assembling position.

10 Claims, 4 Drawing Sheets

CIRCUIT BREAKER AND TERMINAL COVER

BACKGROUND OF THE INVENTION AND RELATED ART STATEMENT

The present invention relates to a terminal cover of a circuit breaker such as a molded-case circuit breaker and an earth leakage breaker, and to an attaching structure of the cover.

In a circuit breaker, a terminal cover is provided for covering a terminal (a threaded terminal) on each of a power source side at one end and a load side at the other end of a main body case (a molded resin case) Accordingly, a live-part is not exposed, thereby preventing an electric shock accident. Patent Reference 1 has disclosed a circuit breaker in which a terminal cover is detachably attached onto a main body case, so that a press ring terminal is secured to a terminal by tightening a screw.

In the structure disclosed in Patent Reference 1, the terminal cover has an engaging hole in each of right and left side walls thereof. When the terminal cover is pushed into the main body case of the circuit breaker from above a terminal section, an engaging projection formed on, an outer surface of each side wall of the main body case is fitted into the engaging hole, so that the terminal cover is snap-fitted to the main body.

Patent Reference 1: Japanese Patent Publication (Kokai) No. 2003-257299

The terminal cover disclosed in Patent Reference 1 has the following disadvantages. The terminal cover is a one-way assembling system. That is, when the terminal cover is attached to the main body case, the terminal cover can be secured at a specific position simply by pressing the terminal cover into the main body case. However, when the terminal cover is detached, it is necessary to insert a tool such as a flat-tip screwdriver from a side into a gap between the main body case and the terminal cover to bend and open the terminal cover. Accordingly, it is difficult to detach the terminal cover at a site where a plurality of circuit breakers is mounted in line in a panel such as a switchboard.

In view of the problems described above, an object of the present invention is to provide a terminal cover of a circuit breaker in which the terminal cover can be easily attached to and detached from the main body case by a simple operation. With the terminal cover, when a press terminal is secured to a terminal by tightening a screw for connecting a cable, it is possible to completely cover the press terminal, so that a live-part is not exposed and a sufficient insulation distance from the press terminal is secured.

Further objects and advantages of, the invention will be apparent from the following description of the invention.

SUMMARY OF THE INVENTION

In order to achieve the objects described above, according to a first aspect of the invention, in a circuit breaker in which terminals with screws on a power supply side and a load side are disposed at a front end section and a rear end section of a main body case containing a current interrupting unit and a switching mechanism, a terminal cover is detachably attached onto an upper surface side of the main body case at a position corresponding to the terminals on each of the power supply side and the load side. A terminal cover attaching surface is formed on an upper surface on each of the power supply side and the load side of a cover of the main body case. The terminal cover is inserted while sliding on the attaching surface from a front end on each of the power supply side and the load side of the main body case, so that the terminal cover is attached to the main body case with a snap-fit coupling unit, thereby securing at an assembling position. Specifically, the snap-fit coupling unit is arranged according to the following aspects of the invention.

According to a second aspect of the invention, the snap-fit coupling unit includes a terminal cover attaching surface formed in a step shape on an upper surface of each of a pair of side walls of the upper surface on each of the power supply side and the load side of the cover of the main body case; a claw-shaped snap-fit fastener provided on a rear side of the upper surface on each of the power supply side and the load side of the cover of the main body case; and a rear end edge of the terminal cover having an engaging groove hole formed at a position facing the claw-shaped snap-fit fastener for fitting the claw of the fastener thereto. Thus, when the terminal cover is pressed into the main body case from the front, the claw of the snap-fit fastener is fitted to the engaging groove hole, so that the terminal cover is secured at the assembling position.

According to a third aspect of the invention, in the second aspect, a release operation surface is formed at the side of the engaging groove hole on a rear part of the upper surface of the terminal cover to be pressed when the terminal cover is detached, so that the claw of the snap-fit fastener is released from the engaging groove hole. In addition, the terminal cover is pulled out toward the front so as to be detached.

According to a fourth aspect of the invention, in the third aspect, a projection line section is formed on the release operation surface formed on the terminal cover for holding a finger. Accordingly, it is easy to find a position for the release operation. Also, when a finger presses the release operation surface, a finger tip does not slip easily, thereby improving the operation.

According to a fifth aspect of the invention, a tapered step is formed at a rear end edge of the release operation surface on the terminal cover for providing a gap between the cover of the main body case for inserting a flat-tip screwdriver from outside to release the terminal cover from the cover of the main body case. Thus, when the terminal cover is detached, it is easy to release the snap-fit fastener with the flat-tip screwdriver.

According to a sixth aspect of the invention, in the second aspect, a unit is further provided for supporting the terminal cover snap-fit coupled to the main body case at the assembling position. The unit includes an engaging projection formed on each of the right and left sides of the terminal cover, and an engaging step formed on an inner surface of each of the right and left side walls of the cover of the main body case so as to face the engaging projection for fitting the engaging projection. Accordingly, it is possible to preventing the terminal cover from coming out upwardly from the main body case due to an increase in an inner pressure of the main body case upon a current interruption in the circuit breaker.

According to a seventh aspect of the invention, a terminal cover is suitable for connecting a wire to the terminals of the main body case by using press terminals. The terminal cover is formed of a long cover extending in a forward direction of the main body case and surrounding whole press terminals tightened by a screw to each of the terminals on each of the power supply side and the load side of the main body case. The cover has inter-phase partitions for isolating the terminal in each phase from others, slits formed in a front surface for leading in a cable, and holes formed in an upper surface for detecting a voltage in respective phases.

According to an eighth aspect of the invention, in the terminal cover, cylinders projecting upwardly from each of the holes for the voltage detection in respective phases and rib-like partitions projecting between the cylinders are integrally molded on the upper surface of the cover for ensuring a sufficient insulation distance between the terminals in respective phases.

According to the invention, the terminal cover is easily attached to and detached from the main body case, thereby improving operability. In particular, in the detaching operation, the terminal cover slides toward the front while being bent with the release operation surface on the upper surface of the terminal cover pressed by a finger. Accordingly, unlike in a conventional structure, the snap-fit coupling can be easily detached without using any tool such as a driver.

Moreover, when cables are connected to terminals of a circuit breaker by using press terminals, the long cover is attached to the main body case as a terminal cover for covering the whole press terminals. Accordingly, it is possible to prevent a hand from touching the press terminals (live-parts), thereby preventing an electric shock accident. It is also possible to ensure a sufficient inter-phase insulation distance between the press terminals.

DETAILED DESCRIPTION OF PREFERRED EMBODIMENTS

Figure 1:
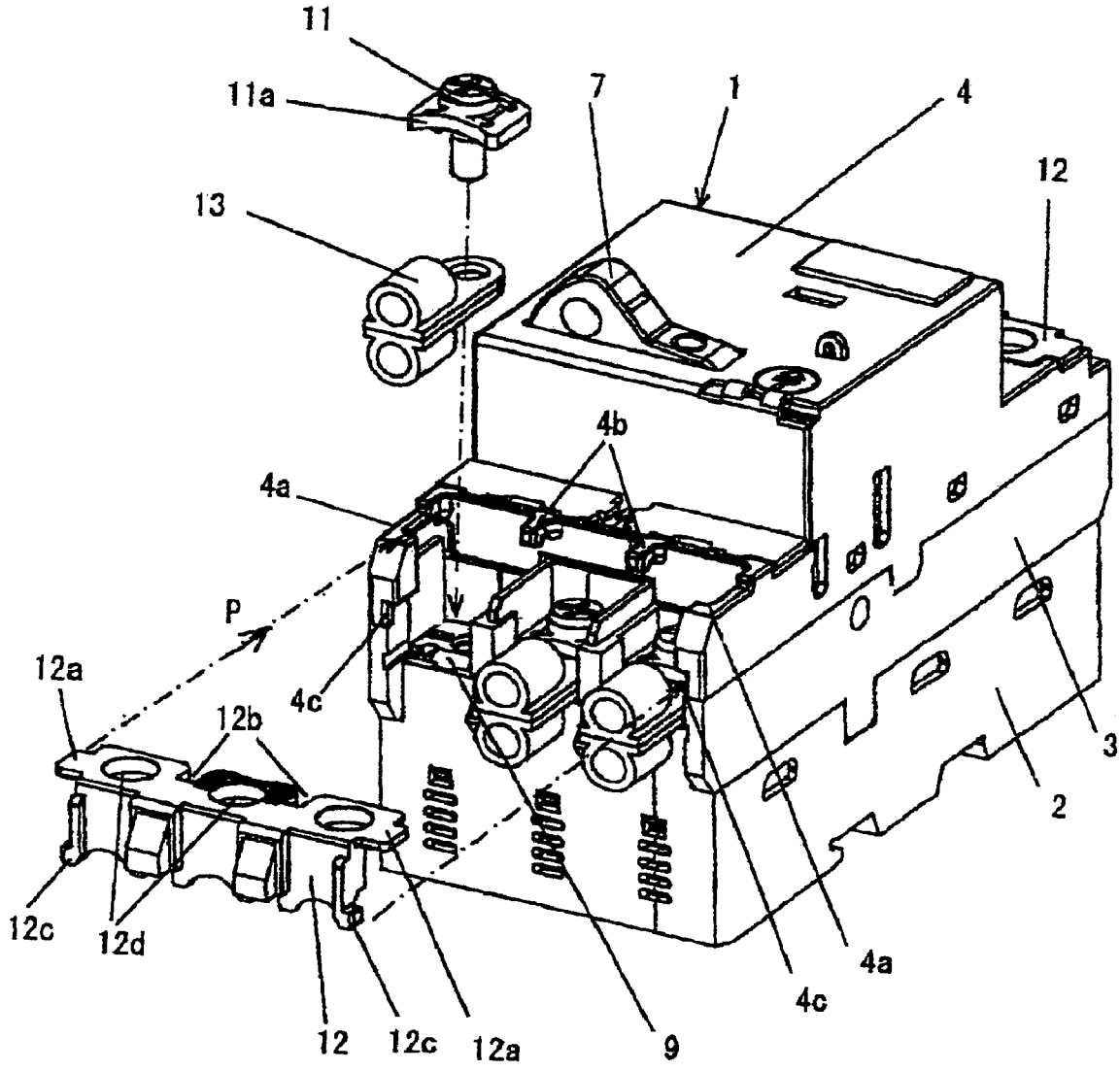
FIG. 1 is an exploded perspective view showing a terminal cover of a circuit breaker according to an embodiment of the invention.

Hereunder, embodiments of the invention will be explained with reference to the attached drawings.

FIG. 1 to FIG. 5 show an embodiment corresponding to the first to sixth aspects of the invention. In FIGS. 4A and 4B showing the whole structure of a circuit breaker, a main body case 1 is a molded resin case with a three-way split structure formed of a lower case 2, an intermediate case 3, and a cover 4. In the main body case 1, there are incorporated principal parts such as a current interrupting unit 5, a switching mechanism 6, a switching operation handle 7, and an over-current tripping device 8.

At one end and the other end of the main body case 1, power supply side terminals 9 and load side terminals 10 of a main circuit are taken out, respectively. A terminal screw 11 is screwed into each of the terminals together with a washer ha to form a terminal section for an external wiring. Furthermore, in correspondence with the positions of the terminals on each of the power supply side and the load side, a terminal cover 12 is detachably attached at each of the front end section and the rear end section of the cover 4 of the main body case 1 for covering the front and the top of the terminal section. In addition, reference numeral 13 in FIG. 1 denotes a press ring terminal fitted to the terminal screw 11 at the terminal section.

Figure 2:
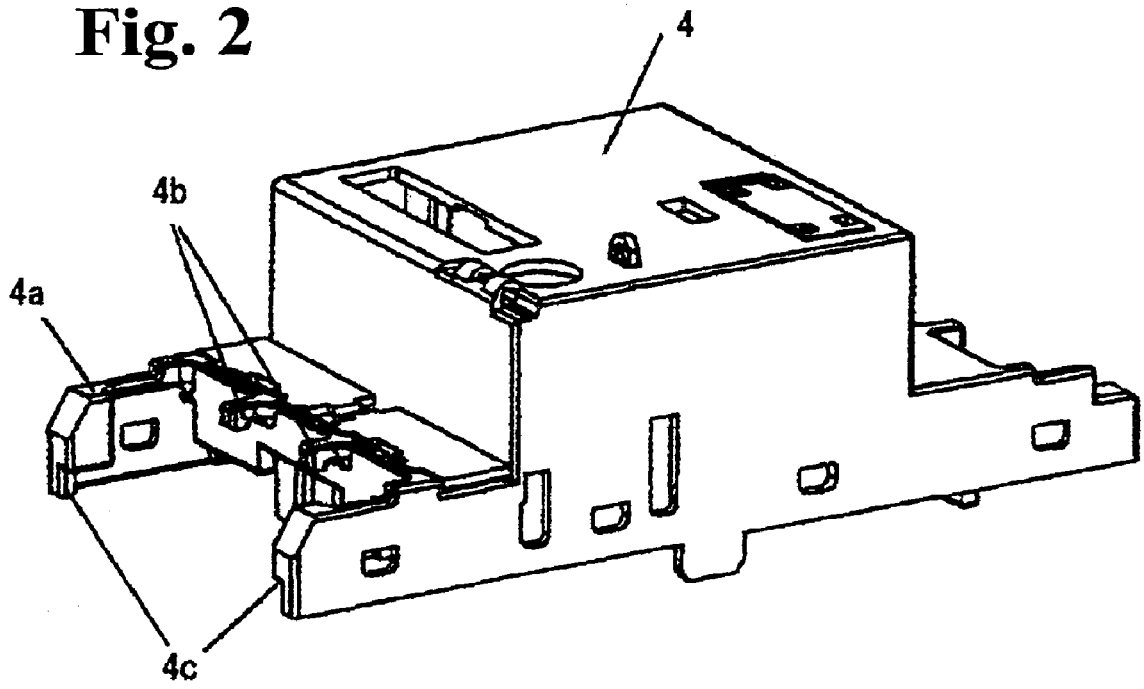
FIG. 2 is a perspective view showing an external shape of a top cover of a main body case shown in FIG. 1.
Figure 3:
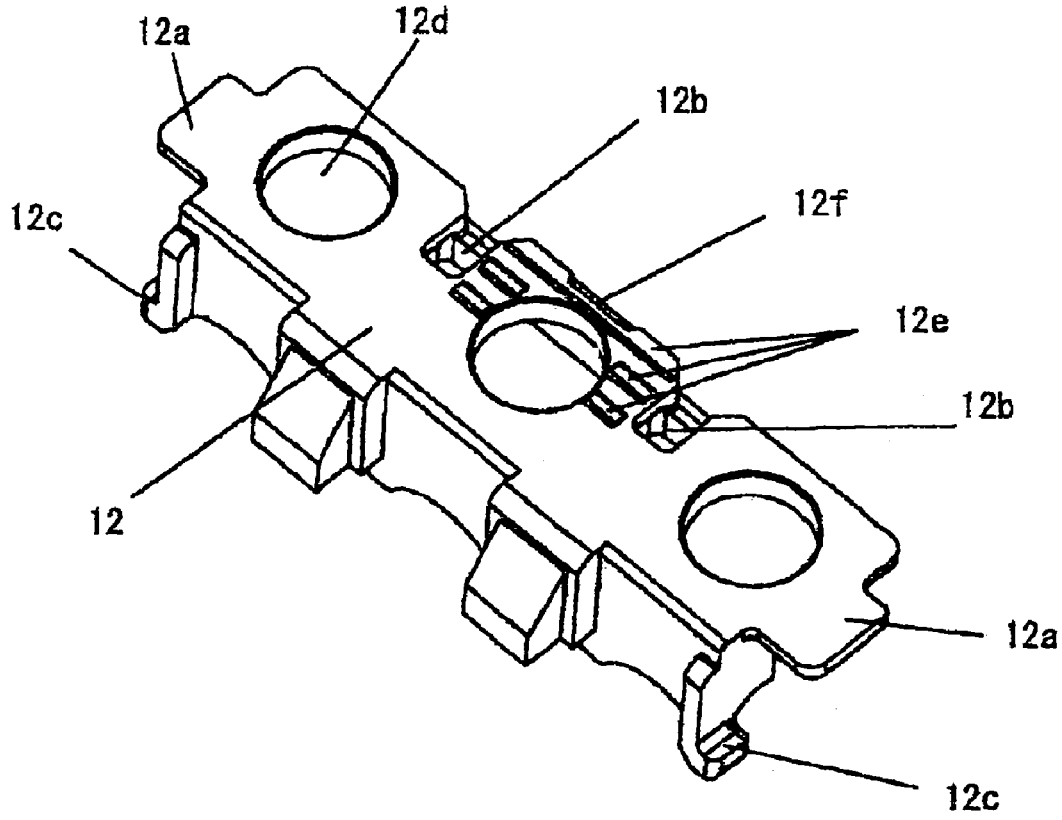
FIG. 3 is a perspective view showing an external shape of the terminal cover shown in FIG. 1.
Figure 4A:
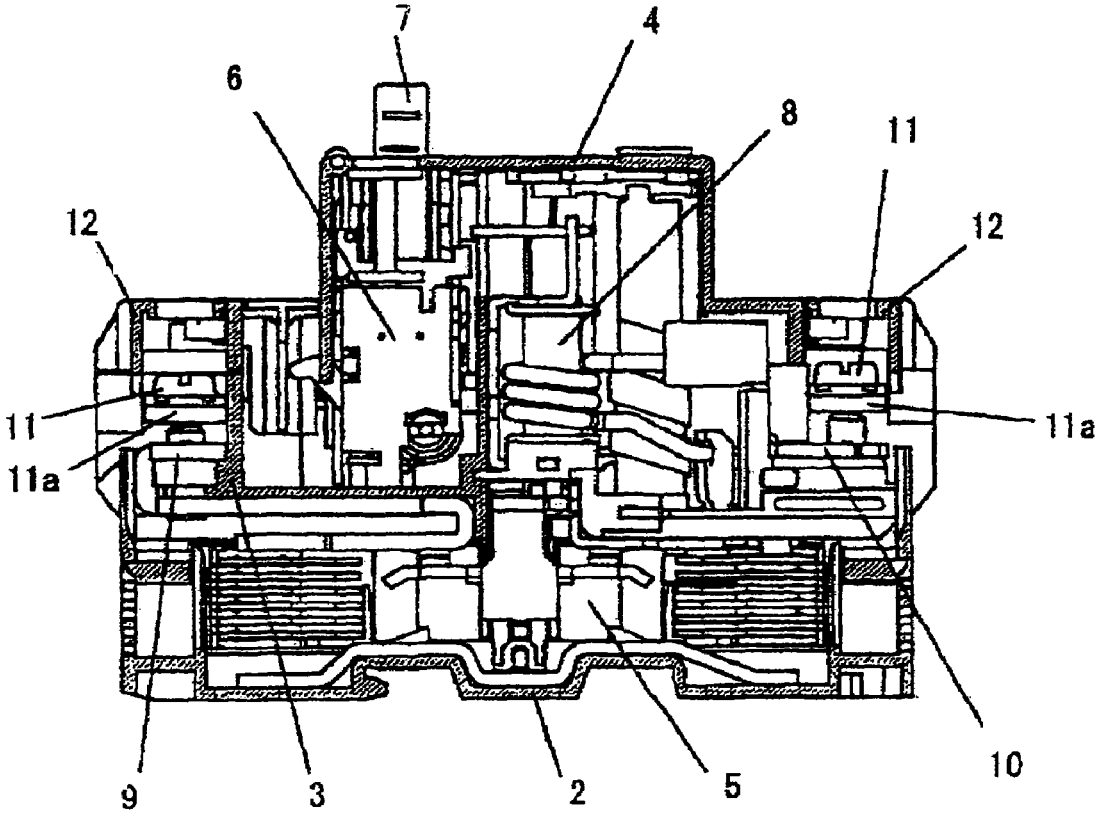
FIG. 4A is a cross sectional side view showing an inner structure of the circuit breaker shown in FIG. 1 in an assembled state.
Figure 4B:
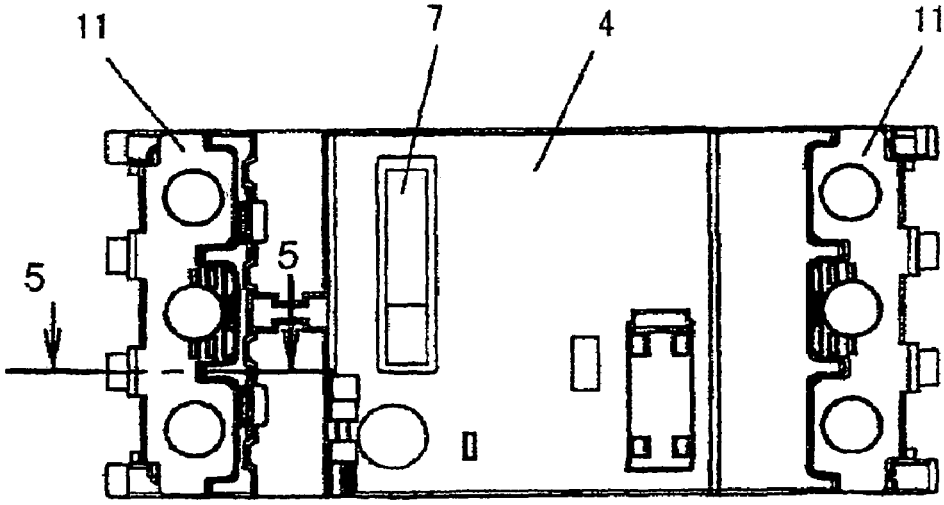
FIG. 4B is a top plan view showing the circuit breaker shown in FIG. 1.

An attaching structure of the terminal cover 12 will be explained next with reference to FIG. 1 to FIG. 3. The terminal cover 12 is secured at a specified position of the cover 4 of the main body case 1 by the snap-fit coupling without a screw (described later). Each of the front and rear sections of the cover 4 has an open upper surface, and the terminal cover 12 is slidably attached to the cover 4 of the main body case 1 while being laid over the right and left side walls of the cover 4. At a top end of each of the right and left side walls of the cover 4, a step-shaped cover attaching surface 4*a* is formed, and the terminal cover 12 inserted from the front of the main body case 1 is placed on the step-shaped cover attaching surface 4*a* to slide thereon.

On a rear side of the cover attaching surfaces 4*a*, a pair of right and left snap-fit fasteners 4*b* projecting forward from an upper wall of the cover 4 is integrally molded. Each of the fasteners 4*b* is made in a shape with a downward hook-like claw at a top of a cantilever. On an inner surface side of each of the right and left side walls of the cover 4, an overhanging engaging step 4*c* is formed.

The terminal cover 12 is a molded part of a resin material having proper flexibility without a reinforcing material such as glass fiber. At each of the right and left ends of the upper plate of the terminal cover 12, a flange 12*a* protruding sideward is formed in correspondence with the step-shaped cover attaching surface 4*a* (slide rail face) formed at the top end of each of the right and left side walls of the cover 4 of the main body case 1. The upper plate of the terminal cover 12 has a pair of right and left engaging groove holes 12*b* formed at the rear end edge in correspondence with the snap-fit fasteners 4*b* with claws. To each of the engaging groove holes 12*b*, the claw of the snap-fit fastener 4*b* is to be fitted.

On an outer surface of each of the right and left side walls of the terminal cover 12, an engaging projection 12*c* is formed in correspondence with the engaging step 4*c* formed on the inner surface of each of the right and left side walls of the cover 4. The engaging projection 12*c* is to be fitted to the engaging step 4*c* from the front. Reference numeral 12*d* denotes a hole for tightening a screw opened in the upper surface of the terminal cover 12 in correspondence with a terminal screw 11 in each of U, V and W phases. As shown in FIG. 3, a rear upper surface area between the engaging groove holes 12*b* is taken as a release operation surface for being pressed with a finger tip, where projection lines 12*e* are formed for being also served as a non-slip projections for a finger.

The terminal cover 12 has a tapered step (a recessed step) 12*f* formed on a part of a rear edge of the release operation surface. When detaching the terminal cover 12, a tip of a tool such as a flat-tip screwdriver is inserted into the tapered step 12*f* for bending the terminal cover 12 instead of pressing the release operation surface with a finger. Thus, the engagement between the claw of the fastener 4*b* and the engaging groove hole 12*b* is released (described later).

In the embodiment, for attaching the terminal cover 12 to the main body case 1 of the circuit breaker, the terminal cover 12 is inserted from the front (in the direction of an arrow P) as shown in FIG. 1 to each of the power supply side and load side terminal sections at the respective ends of the main body case 1. Then, the flanges 12*a* of the terminal cover 12 are laid over the right and left side walls of the cover 4 and pressed toward the rear side while sliding on the upper surfaces of the side walls. Accordingly, the engaging projections 12*c* of the terminal cover 12 are fitted to the respective engaging steps 4*c*.

Figure 5:
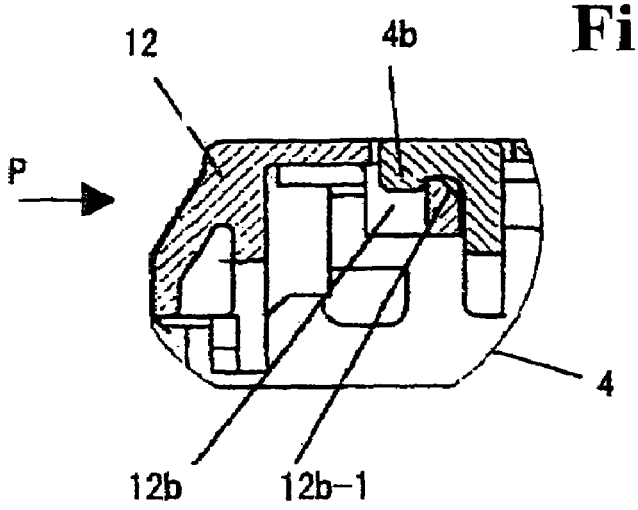
FIG. 5 is a vertical cross sectional view taken along line 5—5 in FIG. 4B and showing the terminal cover in a snap-fit coupled state.

The rear edges of the engaging groove holes 12*b* at the rear end edge of the upper-plate of the terminal cover 12 go under the snap-fit fasteners 4*b*. Accordingly, the claws at the top of the fasteners 4*b* are fitted into the engaging groove hole 12*b* of the terminal cover 12, so that the terminal cover 12 is caught and secured at the specified assembling position as shown in FIG. 5. In this case, each of the rear edges of the engaging groove holes 12*b* is formed to have a tapered surface 12*b*-1. Thus, in the course of pressing the terminal cover 12 in the direction of the arrow P, the claw of the fastener 4*b* passes over the tapered surface 12*b*-1 so as to fit into the engaging groove hole 12*b*.

In the secured state, the claw of the fastener 4*b* is snap-fitted into the engaging groove hole 12*b*, and the engaging projection 12*c* engages the engaging step 4*c*. Accordingly, the terminal cover 12 is secured to the main body case 1 in two directions, i.e., longitudinal and vertical directions. Therefore, the terminal cover 12 is not accidentally detached even though an inner pressure of the main body case 1 increases due to gasses produced by an arc upon over-current interruption.

When the terminal cover 12 is temporarily detached for securing the press ring terminal 13 for cable connection to the terminal by inserting the terminal screw 11 through the press ring terminal 13, the following operation is carried out. When a finger pushes the release operation surface formed on the rear part of the upper surface of the terminal cover 12, the upper plate of the terminal cover 12 is depressed and bent for release. When the claw of the fastener 4*b* is released from the engaging groove hole 12*b*, the terminal cover is pulled out toward the front, thereby easily detaching the terminal cover 12 from the main body case 1.

Instead of pressing the release operation surface of the terminal cover 12 with a finger as described above, a flat-tip screwdriver may be used for releasing the fastener 4*b* to detach the terminal cover 12. In this case, the flat-tip screwdriver is inserted from the operation surface side into a gap between the tapered step 12*f* formed on the rear edge of the release operation surface (see FIG. 3) and the cover 4.

A long-type terminal cover corresponding to the seventh and eighth aspects of the invention will be explained next with reference to FIG. 6. In the embodiment shown in FIG. 1, while the terminal cover 12 attached to the main body case 1 covers the above and the front of the terminal screws 11, cable grip portions of the press terminals 13 connected to the terminal screws 11 protrude frontward and are exposed without a cover. Therefore, the press terminal 13 is a bare press terminal without insulation, and may be directly touched by a hand, thereby causing an electric shock. In addition, when the press terminal 13 pulled out frontward from the terminal section is tightened with the direction of pulling out a cable gripping portion deflected rightward or leftward, a, distance between the adjacent press terminals 13 is reduced, thereby making it difficult to ensure a necessary insulation distance.

Figure 6:
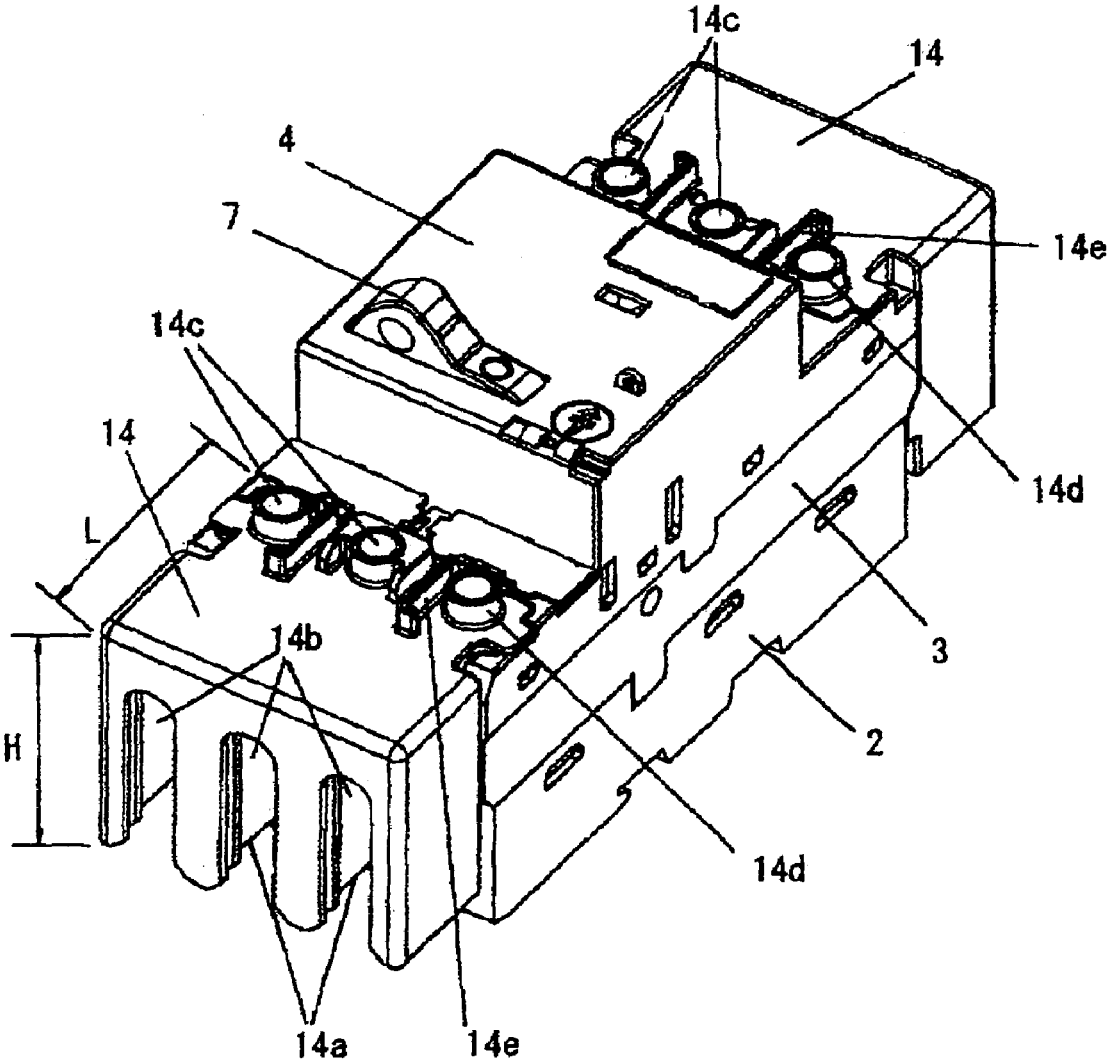
FIG. 6 is a perspective view showing an external appearance of a circuit breaker with a terminal cover according to another embodiment of the invention.

A terminal cover 14 shown in FIG. 6 has an external shape having a large height H and length L and extending toward the front side of the main body case 1 so as to surround the whole press terminals 13 including the cable gripping portions of the press terminals 13 (see FIG. 1) connected to the terminals on each of the power supply side and the load side of the main body case 1. On the terminal cover 14, there are formed inter-phase partitions 14*a* for isolating the terminal in each phase from others, and slits 14*b* formed in the front surface of the terminal cover 14 for leading in a cable. The terminal cover 14 has holes 14*c* formed in an upper surface thereof each corresponding to the terminal screw 11 (see FIG. 1) in each phase for screw tightening and voltage detection.

Cylinders 14*d* projecting upwardly around the holes 14*c* and rib-like partitions 14*e* projecting between the cylinders 14*d* are integrally molded so as to secure a sufficient insulation distance between the terminal screws 11. In attaching the terminal cover 14 to the main body case 1, the snap-fit coupling system in the previous embodiment is used without any modification.

In connecting cables to both of the power supply side and load side terminals of a circuit breaker by using press terminals 13, the long type terminal cover 14 is adopted. The long type terminal cover 14 is attached to the main body case 1 as shown in FIG. 6 to completely surround the press terminals 13. Accordingly, it is possible to prevent a finger from touching the press terminals 13. Each of the inter-phase partitions 14*a* isolates the press terminals 13 from each other to secure an insulation distance. Furthermore, the cylinders 14*d* protrude around the holes 14*c* for voltage detection and the rib-like partitions 14*e* are formed on the upper surface side of the terminal cover 14, thereby securing a sufficient insulation distance between the terminal screws 11.

The disclosure of Japanese Patent Application No. 2004-148751, filed on May 19, 2004, is incorporated in the application.

While the present invention has been explained with reference to the specific embodiments of the invention, the explanation is illustrative and the invention is limited only by the appended claims.

What is claimed is:

1. A circuit breaker comprising:

a main body case having a front end section with an attaching surface, and a rear end section with an attaching surface, terminals with screws disposed at the front end section and the rear end section, respectively, terminal covers detachably attached to the main body case above the rear end section and the front end section, at least one of said terminal covers being slidable and slidably disposed on one of the attaching surfaces of the front and rear end sections, and at least one snapfit coupling unit disposed between the main body case and the slidable terminal cover for snap-fitting the slidable terminal cover into the main body case, wherein said snap-fit coupling unit includes a claw-shaped fastener provided on a rear side of the main body case at the front or rear end section, and an engaging groove provided in a rear end edge of the slidable terminal cover for engaging the claw-shaped fastener, and wherein said slidable terminal cover further includes release operation surface to be pressed for releasing the claw-shaped fastener from the engaging groove, said release operation surface being formed on an upper rear side of the slidable terminal cover and a side of the engaging groove.

2. A circuit breaker according to claim 1, wherein said attaching surface to which the slidable terminal cover is disposed has a step shape.

3. A circuit breaker according to claim 1, wherein said slidable terminal cover further includes a projecting section on the release operation surface for hooking a finger.

4. A circuit breaker according to claim 1, wherein said slidable terminal cover further includes a tapered step at a rear end edge of the release operation surface for inserting a screwdriver from outside to release the slidable terminal cover from the main body case.

5. A circuit breaker according to claim 1, further comprising a supporting unit for supporting the slidable terminal cover relative to the main body case in an assembled state, said supporting unit including engaging projections formed on the slidable terminal cover and engaging steps formed on sidewalls of the main body case facing the engaging projections.

6. A circuit breaker according to claim 1, further comprising a current interrupting unit disposed in the main body case, and a switching mechanism disposed in the main body case.

7. A slidable terminal cover for covering an end section of the circuit breaker according to claim 1, comprising:

a cover main body extending in a forward direction for covering a terminal section attached to the terminal and slidably attached to the main body case of the circuit breaker, and an engaging portion for snap-fitting the cover main body to the main body case.

8. A slidable terminal cover according to claim 7, wherein said engaging portion includes an engaging groove provided in a rear end edge of the cover main body for engaging a fastener provided on a rear side thereof.

9. A slidable terminal cover for covering an end section of the circuit breaker comprising:

a main body case having a front end section with an attaching surface, and a rear end section with an attaching surface, terminals with screws disposed at the front end section and the rear end section, respectively, terminal covers detachably attached to the main body case above the rear end section and the front end section, at least one of said terminal covers being slidable and slidably disposed on one of the attaching surfaces of the front and rear end sections, at least one snap-fit coupling unit disposed between the main body case and the slidable terminal cover for snapfitting the slidable terminal cover into the main body case, and a current interrupting unit disposed in the main body case, and a switching mechanism disposed in the main body case, said slidable terminal cover comprising an inter-phase partition formed on an inner surface thereof for isolating terminals disposed in the end section, a slit formed in a front surface thereof for passing a cable, and a hole formed in an upper surface thereof for measuring a voltage of the terminal.

10. A terminal cover according to claim 9, further comprising a cylinder projecting upwardly around the hole and a partition disposed on the upper surface adjacent to the cylinder.

* * * * *

UNITED STATES PATENT AND TRADEMARK OFFICE

CERTIFICATE OF CORRECTION

PATENT NO. : 7,170,020 B2
APPLICATION NO. : 11/107893
DATED : January 30, 2007
INVENTOR(S) : Hisao Kawata et al.

It is certified that error appears in the above-identified patent and that said Letters Patent is hereby corrected as shown below:

Change column 1, line 14, “case)” to -- case). --,

Change column 1, line 24, “formed on,” to -- formed on --,

Change column 1, line 51, “advantages of,” to -- advantages of --,

Change column 3, line 64, “washer ha” to -- washer 11a --,

Change column 6, line 49, “snapfit” to -- snap-fit --, and

Change column 8, line 15, “snapfitting” to -- snap-fitting--.

Signed and Sealed this

Third Day of April, 2007

JON W. DUDAS
*Director of the United States Patent and Trademark Office*